United States Patent [19]

Bopst, III

[11] Patent Number: 4,653,786

[45] Date of Patent: Mar. 31, 1987

[54] PORTABLE SECURITY LOCK

[76] Inventor: John H. Bopst, III, 409 Chalfonte Dr., Baltimore, Md. 21228

[21] Appl. No.: 770,781

[22] Filed: Aug. 29, 1985

[51] Int. Cl.[4] ..... E05C 19/18

[52] U.S. Cl. ..... 292/295

[58] Field of Search ..... 292/295, 298, 291, 292, 292/293, 294, 296, 258

[56] References Cited

U.S. PATENT DOCUMENTS

| | | | |
|---|---|---|---|
| 936,164 | 10/1909 | Reid . | |
| 1,065,396 | 6/1913 | Rose | 292/295 |
| 1,079,860 | 11/1913 | Kiehle . | |
| 1,171,671 | 2/1916 | Skogland . | |
| 1,579,298 | 4/1926 | Fry et al. | 292/298 |
| 1,590,133 | 6/1926 | Tennyson | 292/292 X |
| 1,971,440 | 8/1934 | Aubertin . | |
| 2,673,112 | 3/1954 | Andrews | 292/296 |
| 3,420,399 | 1/1969 | Heisler | 292/258 X |
| 3,913,962 | 10/1975 | Briggs | 292/292 |
| 3,930,678 | 1/1976 | Alexander | 292/288 |
| 4,169,619 | 10/1979 | McCracken . | |

*Primary Examiner*—Richard E. Moore

*Attorney, Agent, or Firm*—John F. McClellan, Sr.

[57] ABSTRACT

A portable locking system for hinged door improves on the type having a right-angle end of a first member for engaging a strike plate in a door frame and second member with a right angle end for pressing against the door and laterally and detachably engaging the first member. The detachable lateral engagement of this invention includes a series of holes tangential to each other in the first member and a plurality of juxtaposed pins protruding from the second member in position for adjustably engaging any corresponding selected holes in the first member. The system preferably includes a "U"-shaped keeper for holding the first and second members together for carrying them, or after installation. For identification in the dark and for ease in handling, a second angled-end of the hole plate is made longer than the first end. Similarly, one of the legs of the "U"-shaped keeper is made longer than the other.

4 Claims, 2 Drawing Figures

PORTABLE SECURITY LOCK

FIELD OF THE INVENTION

This invention relates generally to locks and particularly to improvements in portable security locks for use with hinged doors and the like.

BACKGROUND OF THE INVENTION

In the prior art, various disclosures as shown by the following U.S. patents have been made of the type doorlock that can be carried from place to place and installed in a room without preparation or modification of a standard door, for engagement of a strike plate or similarly located portion of a door frame with the leading face of an inward-opening hinged door.

U.S. Pat. No. 936,164 to N. W. Reid on 10-5-09 showed a pivotal adjustment door fastener with a hook on one blade or arm and a pusher on another;

U.S. Pat. No. 1,079,860 to G. Kiehle disclosed the same general type drive with cotter-pin-in-hole adjustment and slidable band 13; evidently this could be used also with the door swinging the other way, 11-25-13.

U.S. Pat. No. 1,171,671 to F. T. Skogland, 2-15-16, showed a similar type fastener with toothed adjustment provision;

U.S. Pat. No. 1,971,440 to O. Aubertin, 8-28-34, showed a two-piece unit with coarse slots in a bent-over portion for engaging the front end of the other piece;

U.S. Pat. No. 4,169,619 to J. H. McCracken, 10-2-70, showed another attachment device, this one with a cushion. FIGS. 8–10 showed a toothed slot adjustment.

However, none of the disclosures provided the combination of advantage of the system of applicant's invention, as indicated by the following and other objects.

A principal object is to provide a system as described that is easy to manufacture, requiring only two stamping operations for the basic parts;

Further objects are to provide a system as described that is easy to apply to a door, is substantially self-adjusting, and is strong and reliable;

Yet further objects are to provide a system as described that has for the two basic parts a latching mechanism in duplicate (or greater numbers) for strength, but without complexity of construction or of operation.

Still further objects are to provide a system as described that is adapted for installation or removal in darkness by feeling the relation of the parts, which are purposefully made different.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
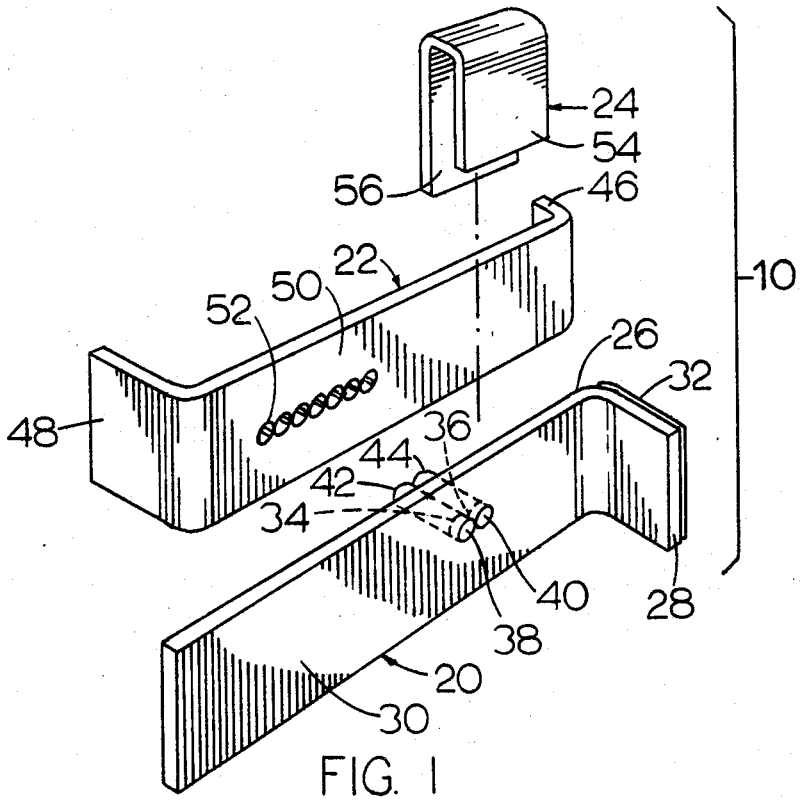
FIG. 1 is an exploded perspective view of the three parts in the preferred embodiment of the invention.

FIG. 1 shows the invention 10 as comprising three parts, all formed from flat strips of metal: first or pin plate 20, an elongate compression member; second or hole plate 22, an elongate tension member; and third or keeper 24, a clip or clamping member.

The pin plate 20 has a bend 26 at a first angled-end or pusher end 28 at right angles to the straight body 30.

End 28 may have on the outer face a thin layer of felt 32 as a cushion to prevent scarring of the door surface, and should not be long enough to strike the base of a door knob when installed. The straight body has at an intermediate location two or more tangential holes 34, 36 or circular apertures through it, on the longitudinal centerline and perpendicular to the face of the plate.

As part of means for adjustably connecting the members 20 and 22, a respective pin 38, 40 fits the length of each hole and protrudes from the pin plate 20 on the side opposite the angled end 28. The pins 38, 40 are made so close together that they preferably touch along the protruding parts, by spacing the holes tangent to each other. The pins may be of steel, force-fitted in the holes and are not working parts relative to the holes in the pin plate. They may be solid, or of the commercial type comprising a springy longitudinally split cylinder. The free ends 42, 44 may be tapered for easier insertion into the holes of the second or hole-plate.

As noted, three or four or more pins can be employed without changing the spirit of the invention; it is only necessary to provide enough holes in the hole plate to give the necessary adjustment for them.

The hole-plate 22 has second and third angle ends, ends 46, 48 bent at right angles, parallel to each other in the same direction; one of these, latch end 46, for tactile identification is shorter than the other or handle end 48, which is too long to engage a latch. Straight along the centerline of the body 50 of the hole plate 22 is a series of tangential holes 52, that may number seven or eight or more, provided so that the ends 42, 44 of the pins 38, 40 can, for adjustably connecting, enter and detachably engage any two adjacent holes in adjustment to fit a particular hinged door and door frame.

The keeper 24, or means for detachably clamping, is "U"-shaped; one leg 54 is shorter than the other leg 56, as means for assuring easy removal. Distance between the legs equals the combined thickness of the bodies of the pin plate 20 and hole plate 22, so that the keeper can resiliently fit on the two bodies when assembled.

Figure 2:
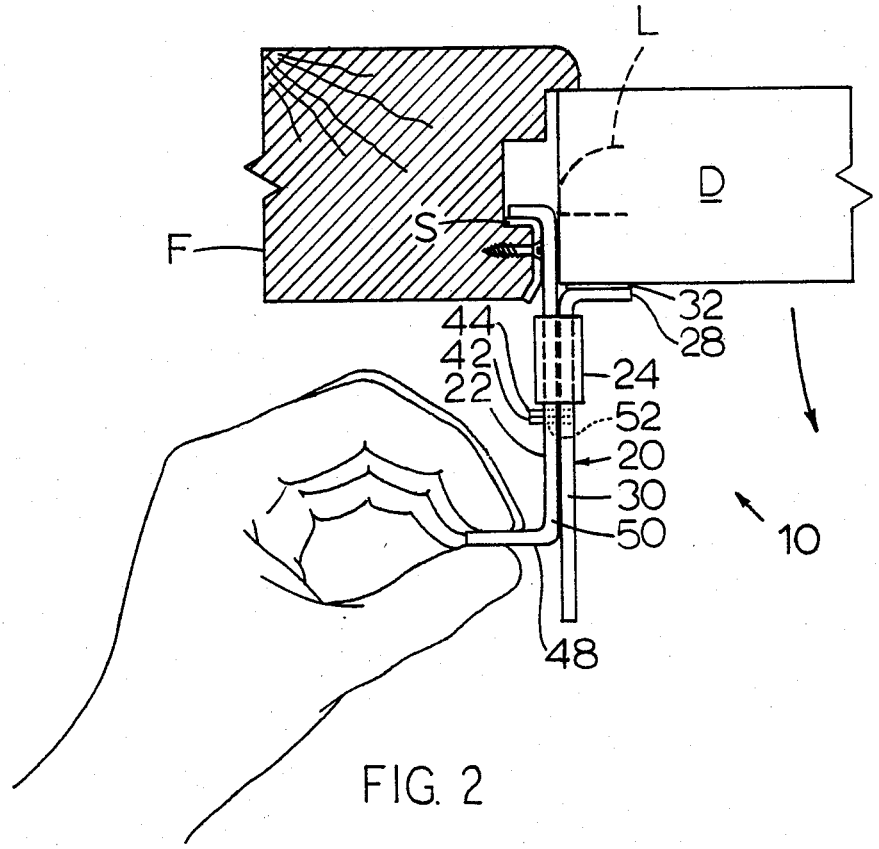
FIG. 2 is a partly sectional plan view showing the invention securing a typical door.

FIG. 2 shows the embodiment 10 assembled and fitting a conventional hinged door D (arrow shows arc of door opening) and door frame F to prevent the door from opening.

It can be seen that the member 20 serves as an elongate compression member relative to the door D, and that the member 22 serves similarly as an elongate tension member, the body or shank of which protrudes between door D and frame F.

There is no way that the door can be opened from the outside with the embodiment 10 in place as shown, short of destruction of parts of the door, door frame or of the embodiment 10.

OPERATION

To install the embodiment 10 requires only a few seconds; the door D is swung open, hole plate 22 held as shown by the handle end 48, is engaged at the latch end to the conventional striker S, the door D is shut, the bent end or pusher end 28 of the pin plate 20 (with felt facing 32, if used) is pressed against the door D and the pin ends 42, 44 are pressed into corresponding holes 52 in the hole plate 22, and the keeper 24 is clipped over the bodies 30, 50 of the pin plate and hole plate, securing them together detachably.

The keeper is optional. If used for additional security it can be installed as shown on the inboard end adjacent the door D and door frame F, or it can be installed on the outboard end, the pins and holes being at an intermediate location to permit the clamp to be installed at either end.

A would-be intruder would have a difficult time trying to bend or dislodge the system of the invention but, as can be seen, the system can be installed quickly, and it can be removed instantly by the user.

Removal requires only pressing up on the keeper (if used) the longer leg of which protrudes below the bodies 30 and 50 for the purpose of tactile identification, then separating the plates, and the door can be opened.

From the above, it will be appreciated that the system can be used with almost any hinged door with striker plate, that the system cannot be seen or manipulated from the exterior of the door, that it is chainless, hingeless, boltless, latchless, screwless and keyless.

Further, as to manufacture, only one operation would be required to make each of the three pieces of the preferred embodiment. Apart from the clip, the entire system could be completed in two stamping operations, plus fixing of the pins 38, 40 and, if desired, attaching the felt 32, which is optional. The clip can be made in one operation.

Steel is the preferred material. The pins in plate 20 may be 3/32 inch (2.4 mm) in diameter, and the holes in plate 22 in which the pins fit may be 7/64 inch (2.8 mm) in diameter. The closeness of the plurality of pins and holes tends to multiply the resistance of the mechanism to outside forces and holds the plates 20 and 22 level with each other. The strap material from which the plates 20 and 22 are made may be ⅛ inch (3 mm) thick.

Although the invention is illustrated with the door at the right, it requires only inverting the assembly to fit when the door happens to be at the left.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a portable security lock system of the type usable with a hinged door that has a latch for engaging a latch socket in a door frame, an elongate compression member with a first angled end, an elongate tension member with a second angled end for engaging a said latch socket and having a shank for protruding from said latch socket between a said door and door frame, and means for adjustably connecting the elongate tension member and the elongate compression member for pressing said first angled-end against a door and preventing the door from opening, the improvement comprising: the means for adjustably connecting including structure defining a series of holes along the length of one of said elongate compression member and elongate tension member, a plurality of pins fixed in adjacent disposition in the other of said elongate compression member and elongate tension member in position for engaging a plurality of said holes, means for detachably clamping the elongate compression member to the elongate tension member at a location therealong and the means for detachably clamping being a "U"-shaped clip with first and second legs, and means for assuring easy removal of the "U"-shaped clip, comprising the first leg being longer than the second leg for protruding below the elongate compression member and elongate tension member.

2. In a portable security lock system of the type usable with a hinged door that has a latch for engaging a latch socket in a door frame, an elongate compression member with a first angled end, an elongate tension member with a second angled end for engaging a said latch socket and having a shank for protruding from said latch socket between a said door and door frame, and means for adjustably connecting the elongate tension member and the elongate compression member for pressing said first angled-end against a door and preventing the door from opening, the improvement comprising: the means for adjustably connecting including structure defining a series of holes along the length of one of said elongate compression member and elongate tension member and a plurality of pins fixed in adjacent disposition in the other of said elongate compression member and elongate tension member in position for engaging a plurality of said holes, said series of holes being tangent to one another, and said plurality of pins being in lengthwise contact with each other.

3. In a system as recited in claim 2, said plurality of pins being fixed in a corresponding plurality of circular apertures tangent to each other.

4. In a system as recited in claim 3, a "U"-shaped clip for clamping together the elongate compression member and the elongate tension member, and said series of holes and plurality of pins being at an intermediate location for permitting the "U"-shaped clip to clamp the elongate compression member and the elongate tension member together at either end of said series of holes.

* * * * *